US005823544A

United States Patent [19]

Ellis et al.

[11] Patent Number: 5,823,544

[45] Date of Patent: Oct. 20, 1998

[54] ANTI-ABRASION AND ROCKERING SYSTEM FOR AN IN-LINE SKATE

[75] Inventors: Todd D. Ellis, Boston, Mass.; Daniel A. Nolan, Salem, N.H.

[73] Assignee: Reebok International Ltd., Stoughton, Mass.

[21] Appl. No.: 796,428

[22] Filed: Feb. 6, 1997

[51] Int. Cl.[6] ..... A63C 17/06

[52] U.S. Cl. ..... 280/11.22; 280/7.13; 280/11.27; 301/5.3

[58] Field of Search ..... 301/503; 280/7.1, 280/7.13, 11.19, 11.22, 11.27, 11.28, 43

[56] References Cited

U.S. PATENT DOCUMENTS

| | | | |
|---|---|---|---|
| 177,566 | 5/1876 | Saladee . | |
| 576,106 | 2/1897 | Frankenberg et al. . | |
| 2,605,812 | 8/1952 | Benze | 280/7.1 |
| 2,644,692 | 7/1953 | Kahlert . | |
| 3,387,852 | 6/1968 | De Sarro . | |
| 3,880,441 | 4/1975 | Silver . | |
| 4,058,324 | 11/1977 | Dallaire . | |
| 4,273,345 | 6/1981 | Ben-Dor et al. . | |
| 4,603,868 | 8/1986 | Schütz . | |
| 4,909,523 | 3/1990 | Olson . | |
| 5,048,848 | 9/1991 | Olson et al. . | |
| 5,068,956 | 12/1991 | Malewicz . | |
| 5,092,614 | 3/1992 | Malewicz . | |
| 5,253,884 | 10/1993 | Landers . | |
| 5,366,232 | 11/1994 | Pozzobon et al. . | |
| 5,374,072 | 12/1994 | Landers . | |
| 5,385,356 | 1/1995 | Conte . | |
| 5,388,846 | 2/1995 | Gierveld . | |
| 5,411,277 | 5/1995 | Pratt | 280/11.22 |
| 5,411,278 | 5/1995 | Wittmann . | |
| 5,505,470 | 4/1996 | Hoshizaki . | |
| 5,586,777 | 12/1996 | Wolf | 280/11.27 X |
| 5,603,519 | 2/1997 | Conte . | |

OTHER PUBLICATIONS

Strong, Brent A., Ph.D., "Versatility in Pultrusion", *Composites Fabrication*, Jun. 1996, pp. 9–13.

*Primary Examiner*—Eric D. Culbreth
*Assistant Examiner*—Michael Mar
*Attorney, Agent, or Firm*—Sterne, Kessler Goldstein & Fox P.L.L.C.

[57] ABSTRACT

An anti-abrasion and rockering system for an in-line skate. The skate includes a skate boot mounted on a chassis. The chassis includes two sidewalls which are parallel and opposite to each other. Each sidewall has a row of holes formed therein, such that the holes on the first sidewall align with and are opposite to the row of holes on the opposing sidewall. Two of the opposing sets of holes are oblong. A plurality of axles are disposed in the holes on the chassis so that the wheels are rotatably mounted on the axles and between the sidewalls of the chassis. The anti-abrasion and rockering system for the skate includes bushings disposed in the holes in the chassis. The bushings disposed in the oblong holes slide up and down in the holes. An anti-abrasion and rockering plate is disposed on the exterior of each sidewall. Each plate has a first and second row of holes for accommodating the axles. The first row of holes is misaligned so that some of the wheels on the skate are higher with respect to the skating surface than other wheel such that the front and rear wheels of the skate are rockered. The second row of holes is aligned so that all the wheels are at the same distance from the skating surface, so that the wheels are not rockered. To switch from the rockered to non-rockered state, the skater removes the plates from the chassis, turns the plates 180 degrees and reattaches each plate to the chassis.

4 Claims, 6 Drawing Sheets

ANTI-ABRASION AND ROCKERING SYSTEM FOR AN IN-LINE SKATE

BACKGROUND OF THE INVENTION

1. Field of the Invention

The present invention relates to an anti-abrasion and rockering system for an in-line skate. In particular, the present invention relates to a system for rockering the wheels of an in-line skate using an exterior plate which also prevents abrasion of the chassis of the skate.

2. Related Art

In-line skates use two or more wheels arranged in tandem. These skates were originally designed as a substitute for ice skates for training in the off season. Thus, in-lines skates were first used by hockey players and speed skaters for training. In recent years, the popularity of in-line skating has grown, and in-line skating has developed into a sport of its own, apart from their use as a training aid. However, in-line skates still emulate ice skates in one respect. In particular, the wheels of an in-line skate may be rockered so that they emulate the curve of a typical ice skate blade.

Rockering refers to a state of skate wheels in which the center wheels of an in-line skate are lower with respect to the skating surface than the outermost wheels. This wheel configuration is generally used on in-line skates for certain activities. For example, roller hockey requires a skater to turn and maneuver quickly, with relatively short bursts of speed. The fewer wheels that come in contact with the skating surface, the easier it is to turn and maneuver on the skates. Thus, many skaters rocker the wheels of their in-line skates in order to increase the maneuverability of the skates for hockey, or other similar activities.

Systems have been devised for rockering the wheels of an in-line skate. One system uses plugs in the chassis of the skate. The plugs have holes for accommodating the wheel axles. The hole in each plug is off-center so that the skater may rocker the wheels by removing the plugs and rotating them 180 degrees to raise or lower the wheel axles with respect to the skating surface.

A similar system uses triangular shaped plugs with a hole located off-center in each plug. Thus, the skater may rocker the wheels by removing the plug and rotating it to raise or lower the wheel axles. In this system, the skater has three different settings for the height of the wheel axles.

In both of the conventional rockering systems described above, the user must remove the wheel axles and the plugs on either side of each wheel to be rockered. This procedure involves removing at least four plugs from each skate, rotating and reinserting the plugs and then reassembling the wheels and wheel axles on the chassis.

What is needed is a system to easily and quickly raise or lower the wheels of an in-line skate so as to rocker the wheels for better maneuverability and control during hockey and other similar activities. Further, what is needed is a rockering system with a minimal number of parts that have to be removed and reassembled.

SUMMARY OF THE INVENTION

The anti-abrasion and rockering system of the present invention is disposed on an in-line skate having a chassis. The chassis includes two sidewalls which are parallel to each other. Each sidewall has a row of holes formed therein, such that the holes on the first sidewall align with and are opposite to the row of holes on the opposing sidewall. At least one of the opposing sets of holes are oblong. Wheel axles are disposed in the opposing holes on the chassis so that the wheels are rotatably mounted on the axles and between the sidewalls of the chassis.

The anti-abrasion and rockering system for the skate includes bushings disposed in said holes in the chassis. The bushings disposed in the oblong holes slide up and down in the holes relative to the skating surface. An anti-abrasion and rockering plate is disposed on the exterior of each sidewall. Each plate has a first and second row of holes for accommodating the wheel axles. The first row of holes on the plate is misaligned, and the second row of holes is aligned.

To rocker the wheels of the in-line skate, the skater assembles the skate so that the wheel axles are inserted through the misaligned row of holes on each plate. The wheel axles and wheels are thus disposed at different distances from the skating surface so that not all of the wheels touch the ground. The bushings are slid up or down in the oblong holes in the chassis to accommodate the position of the wheel axles.

Similarly, to adjust the wheels so that all the wheels touch the skating surface in a non-rockered state, the skater removes the wheels axles and anti-abrasion and rockering plates and rotates the plates 180 degrees so that the wheel axles are inserted through the aligned row of holes on the plate. Again, the bushings are slid up or down in the oblong holes of the chassis to accommodate repositioning of the wheel axles. This system minimizes the number of parts that must be reassembled in order to rocker the wheels of the skate.

Further, the anti-abrasion and rockering plate covers a substantial portion of the exterior of the sidewalls of the chassis. As such, the plate prevents abrasion of the sidewalls that often occurs, for example, while making sharp turns. Abrasion of the chassis is a particular problem in skates used for hockey or "aggressive" skating.

BRIEF DESCRIPTION OF THE FIGURES

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENTS

A preferred embodiment of the present invention is now described with reference to the figures where like reference numbers indicate identical or functionally similar elements. Further, although only one skate in a pair of skates is shown in the figures, the left and right skates are mirror images of each other. While specific configurations and arrangements are discussed, it should be understood that this is done for illustrative purposes only. A person skilled in the relevant art will recognize that other configurations and arrangements can be used without departing from the spirit and scope of the invention.

Figure 1:
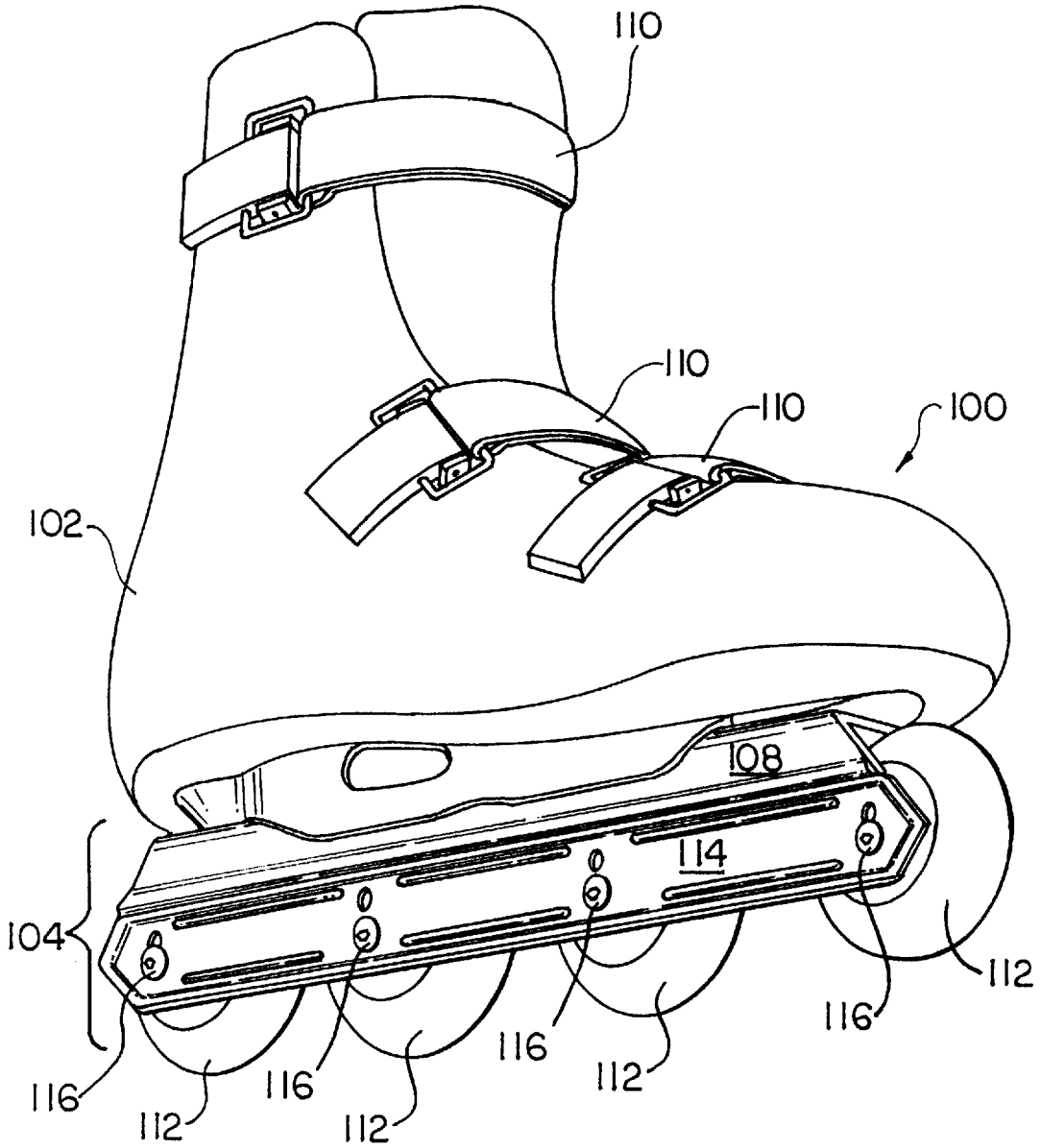
FIG. 1 shows a perspective view of a skate having an anti-abrasion and rockering system of the present invention.

FIG. 1 shows a skate 100 having a boot 102 and a chassis 104. Boot 102 may be made from a soft material, such as nylon or leather, or may be injection molded from a plastic material or made using other processes apparent to one skilled in the relevant art. Chassis 104 includes a transition mount 106 and a frame 108. In one embodiment, frame 108 is made by the pultrusion.

Pultrusion is a process for making composite parts having a nearly constant cross-section on a continuous basis. In the pultrusion process, fibers, including fiber mats or cloths, are joined to form a fiber bundle which is soaked in a resin bath until it is completely wetted. Excess resin is then removed from the wetted fiber bundle, and the bundle is directed into a heated die. The part is then shaped and cured in the die. The die interior dimensions gradually reduce in size until the final shape is achieved. During this shaping, the part is cured by either thermally heating the die or by subjecting the material to radio frequency (rf) radiation. A puller system, either a series of part-shaped grippers or double continuous belts or caterpillar pullers, pull the part through the die. Part cut-off and packaging is completed after the puller. This process is described in further detail in an article by A. Brent Strong, Ph.D., entitled "Versatility in Pultrusion," *Composites Fabrication,* June, 1996, pp. 9–13, the disclosure of which is incorporated herein by reference.

In another embodiment, frame 108 is made from extruded aluminum. However, it would be apparent to one skilled in the relevant art that frame 108 could also be made by injection molding, die casting, machining or other known manufacturing techniques.

Transition mount 106 is used to accommodate frame 108 and to provide a raised footbed for the skater. In one embodiment, transition mount 106 is made by injection-molding. However, it would be apparent to one skilled in the relevant art that transition mount 106 could also be made by extrusion, die casting, machining or other known manufacturing techniques. In another embodiment, frame 108 and transition mount 106 can be injection molded from a single piece of material to form a unitary chassis 104. Similarly, it would be apparent to one skilled in the relevant art, to mold boot 102 and chassis 104 as a unitary member.

Skate 100 further includes fastening means 110. As shown in FIG. 1, fastening means 110 comprises buckles. However, laces or hook and pile type fasteners could also be used as fastening means 110. Skate 100 also has a plurality of wheels 112 rotatably mounted on frame 108. Although wheels 112 are shown in FIG. 1 as being aligned, it would be apparent to one skilled in the relevant art that other wheel configurations could also be used.

An anti-abrasion and rockering plate 114 of the present invention is mounted on exterior medial and lateral sidewalls 302 and 304 of frame 108. As described in further detail below, anti-abrasion and rockering plate 114 is attached to frame 108 via wheel axles 116 and can be removed, rotated and reassembled to rocker wheels 112.

Figure 2:
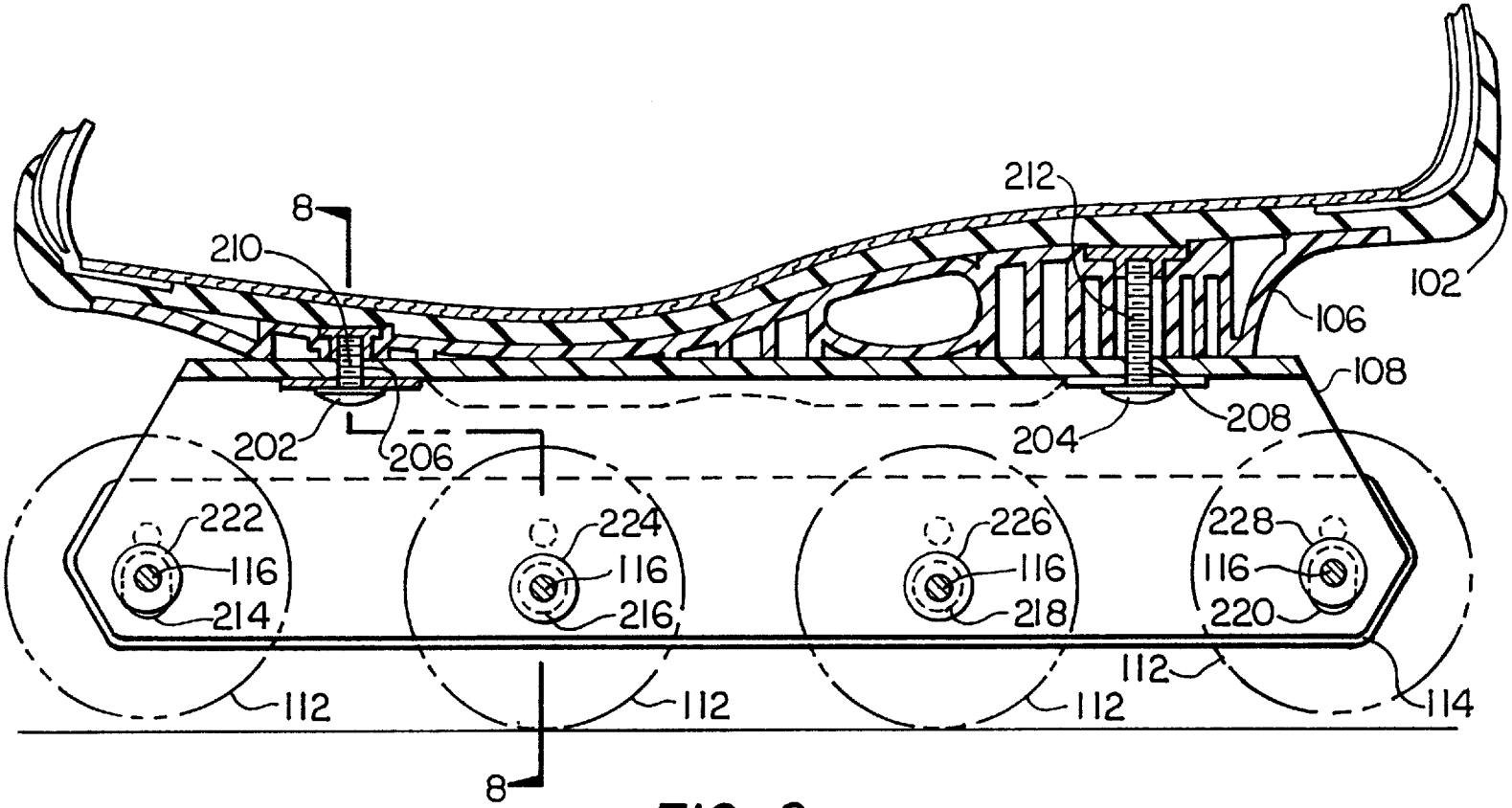
FIG. 2 shows a partially sectional side view of the skate as shown in FIG. 1.

Boot 102 may be rigidly attached to transition mount 106 by gluing, screwing or other means apparent to one skilled in the relevant art. As shown in FIG. 2, transition mount 106 is attached to frame 108 by screws 202 and 204. Frame 108 has two holes 206 and 208 formed therethrough. Corresponding holes 210 and 212 are formed in the bottom surface of transition mount 106. When transition mount 106 is placed atop frame 108, holes 206 and 208 of frame 108 and holes 210 and 212 of transition mount 106 align, so that screws 202 and 204 may be inserted into the holes to join frame 108 and transition mount 106. Holes 210 and 212 of transition mount 106 are threaded to accommodate screws 202 and 204.

Figure 3:
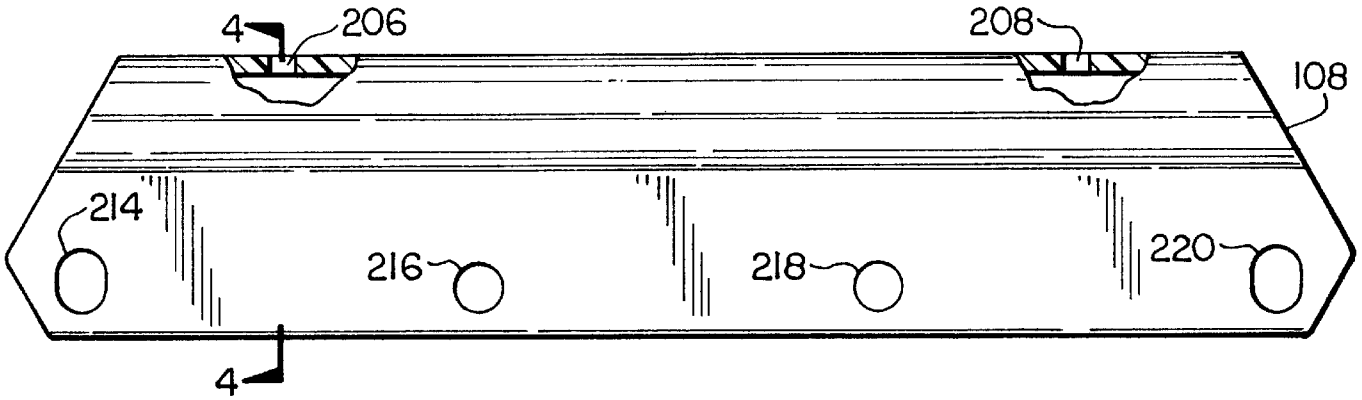
FIG. 3 shows a side plan view of a frame of the anti-abrasion and rockering system of the present invention.
Figure 4:
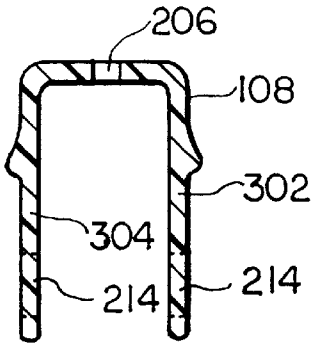
FIG. 4 shows a cross-sectional view of the frame as shown in FIG. 3, taken along a line 4—4.

Wheels 112 are rotatably mounted on axles 116 which are mounted through frame 108. As shown in FIGS. 3 and 4, frame 108 has corresponding sets of holes 214, 216, 218 and 220 each formed in a medial sidewall 302 and a lateral sidewall 304 thereof. As shown, medial and lateral sidewalls 302 and 304 are parallel and opposite to each other. Holes 214 and 220 are oblong, and holes 216 and 218 are circular. As shown in FIG. 3, each hole has a bushing 222, 224, 226 and 228, respectively, rotatably mounted therein. Thus, bushings 222 and 228 can freely rotate and translate up and down within holes 214 and 220.

Figure 8:
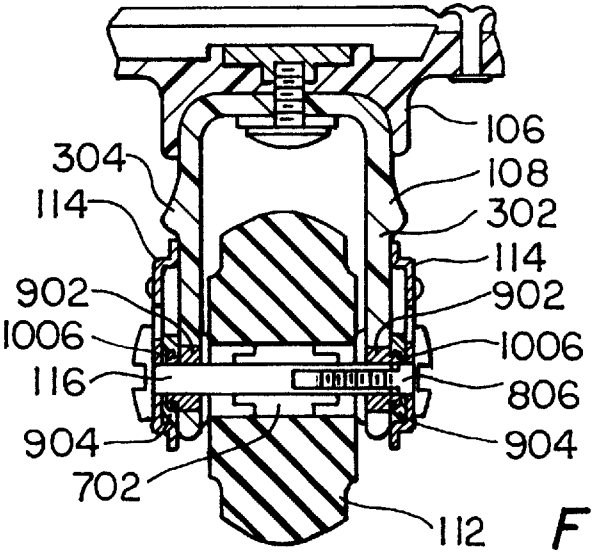
FIG. 8 shows a sectional view of a portion of the skate as shown in FIG. 2, taken along a line 8—8.
Figure 10:
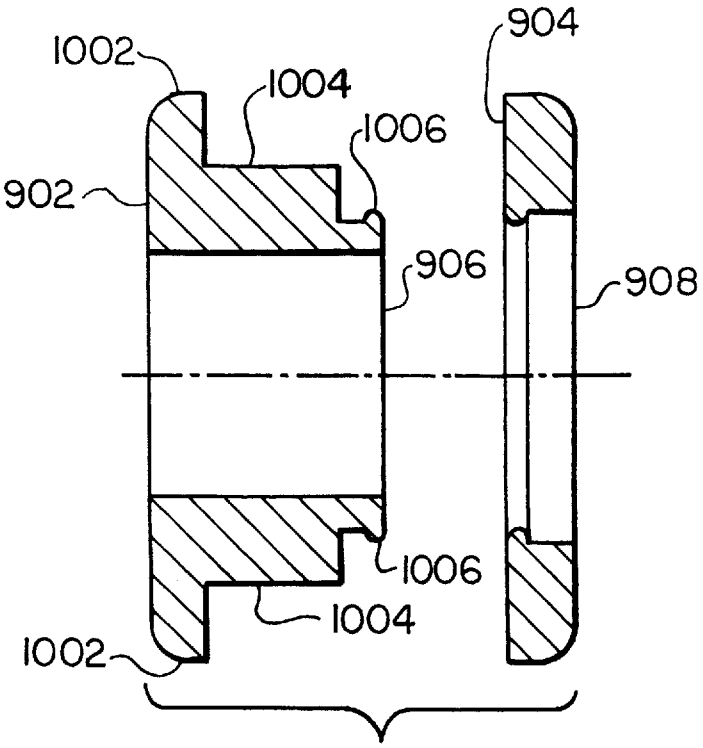
FIG. 10 shows an exploded sectional side view the two-part bushing as shown in FIG. 9.
Figure 9:
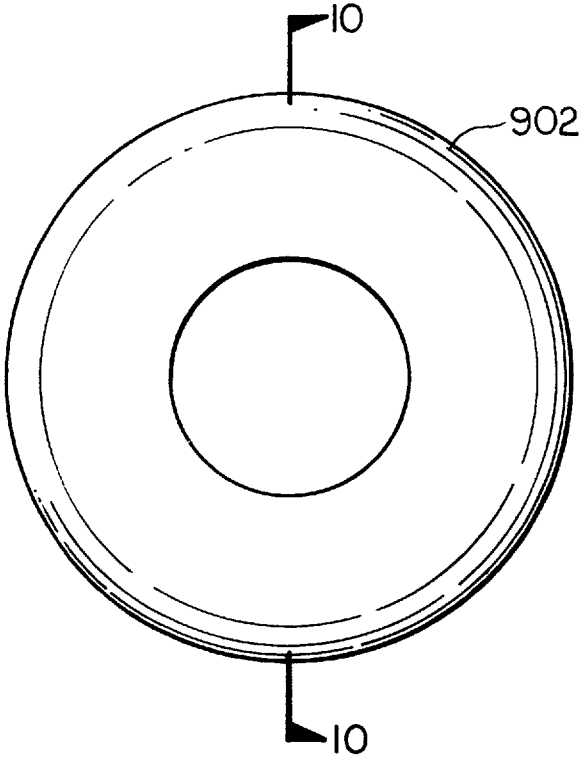
FIG. 9 shows a top plan view of a two-part bushing of the present invention.

In one embodiment, bushings 222–228 are formed in two-pieces. A top view of bushing 222 is shown in FIG. 9, and an exploded view of bushing 222 is shown in FIG. 10. Bushing 222 includes a first half 902 and a second half 904. Each half has a hole 906 and 908, respectively, formed therethrough for accommodating axle 116. First half 902 of bushing 222 further includes a rim 1002, an outwardly projecting portion 1004 and a ridge 1006. Ridge 1006 has a diameter equal to the diameter of hole 908 of second half 904, so that the two halves can be snapped together. In use, first half 902 of bushing 222 is inserted into hole 214 of frame 108 from the interior of one of the sidewalls 302, 304 so that ridge 1006 extends just beyond the exterior surface of the sidewall, as shown in FIG. 8. Second half 904 is then snapped onto ridge 1006 of first half 902 to retain busing 222 in hole 214. Similarly, bushings 224–228 are mounted in corresponding sets of holes 216–220 in medial and lateral sidewalls 302, 304 of frame 108.

In one embodiment, first half 902 is made of aluminum and second half 904 is made from a plastic. However, in an alternate embodiment, first and second halves 902 and 904 may be made from plastic or other materials that are apparent to one skilled in the relevant art.

Figure 5:
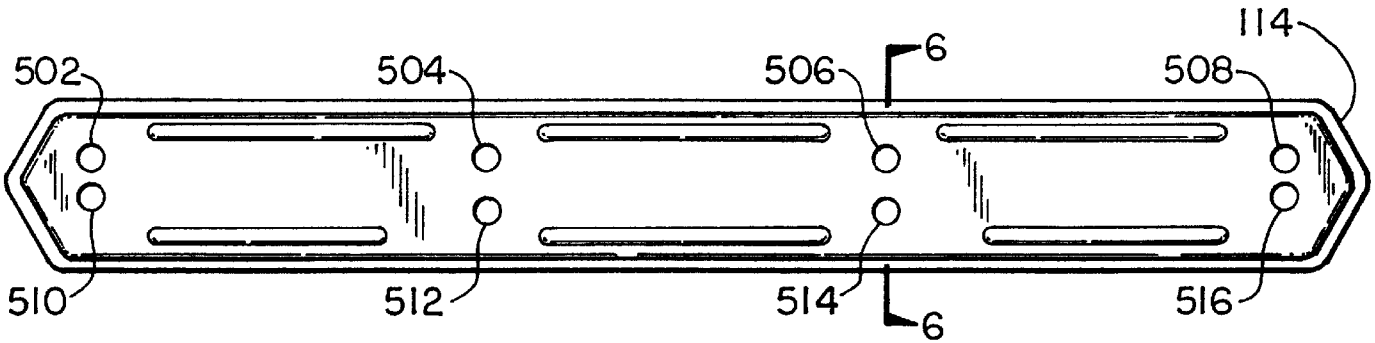
FIG. 5 shows a side plan view of the anti-abrasion and rockering plate of the present invention.
Figure 6:
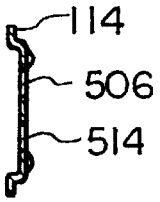
FIG. 6 shows a cross-sectional view of the anti-abrasion and rockering plate as shown in FIG. 5, taken along a line 6—6.

Anti-abrasion and rockering plate 114 is shown in further detail in FIGS. 5 and 6. Plate 114 has a first row of holes 502, 504, 506 and 508 and a second row of holes 510, 512, 514 and 516. First row of holes 502–508 are all in a straight line horizontally along plate 114. However, second row of holes 510–516 are offset slightly from one another or misaligned so that holes 510 and 516 are slightly higher than holes 512 and 514. In the preferred embodiment, holes 510 and 516 are offset from holes 512 and 514 by approximately 1/16 to 1/8 inch.

Figure 7:
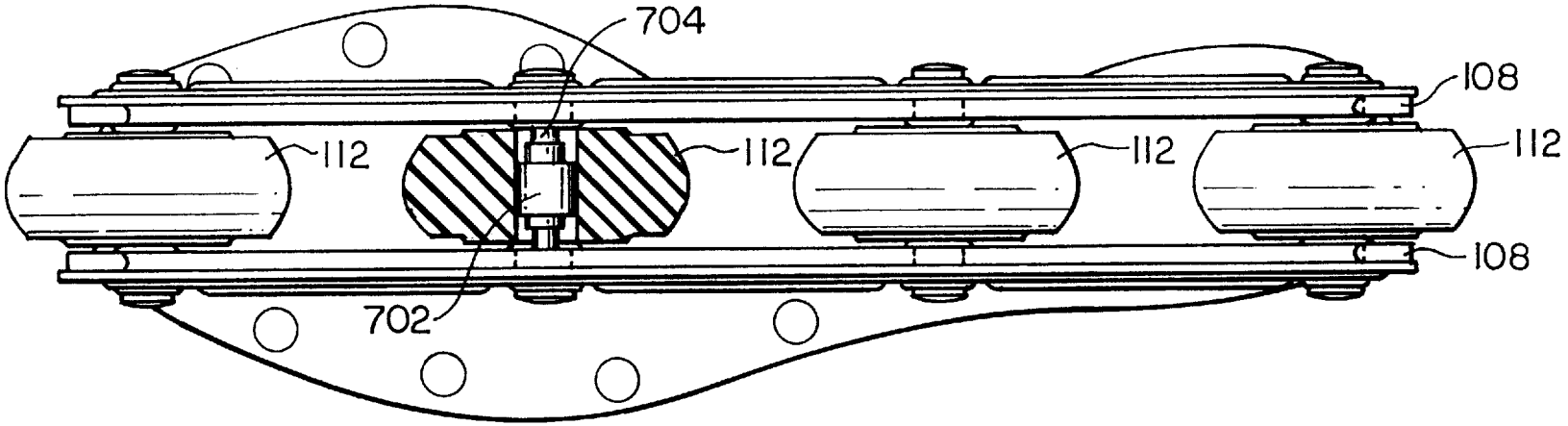
FIG. 7 shows a bottom, partially sectional, plan view of the skate as shown in FIG. 1.

As shown in FIGS. 7 and 8, wheels 112 have a conventional bearing assembly 702 disposed therein and a hole 704 formed therethrough to accommodate axles 116. To assemble the anti-abrasion and rockering system of the present invention, first half 902 and second half 904 of bushings 224 are snapped into holes 216 formed in medial sidewall 302 and lateral sidewall 304 of frame 108, as described above. Once bushings 224 are inserted in holes 216, wheel 112 can be inserted between sidewalls 302, 304 of frame 108, so that hole 704 in wheel 112 aligns with holes 906 and 908 of bushing 224. Anti-abrasion and rockering plate 114 is then placed along the exterior of lateral sidewall 304. Depending on whether the wheels are to be rockered or non-rockered, holes 512 or 504, respectively, are aligned with the holes in wheel 112 and bushing 224 so that axle 116 can be slid therethrough. A second anti-abrasion and rockering plate 114 is placed along the exterior of medial sidewall 302. As described above, holes 512 or 504 are aligned with the holes in wheel 112 and bushing 224. A screw 806 is then screwed into a threaded hole (not shown) in axle 116 to retain axle 116 in frame 108.

Figure 11:
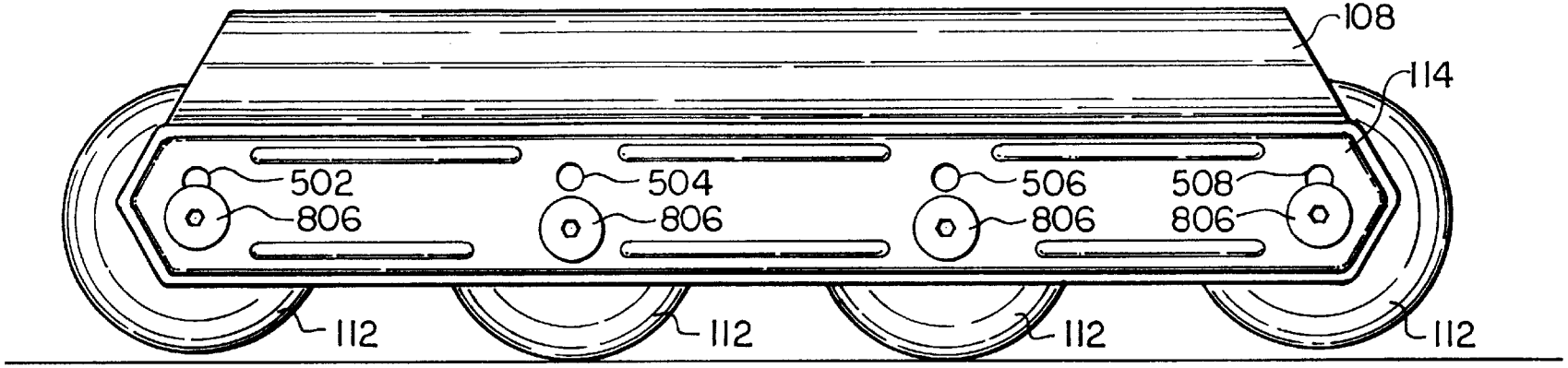
FIG. 11 shows the anti-abrasion and rockering system of the present invention with wheels in a rockered state.
Figure 12:
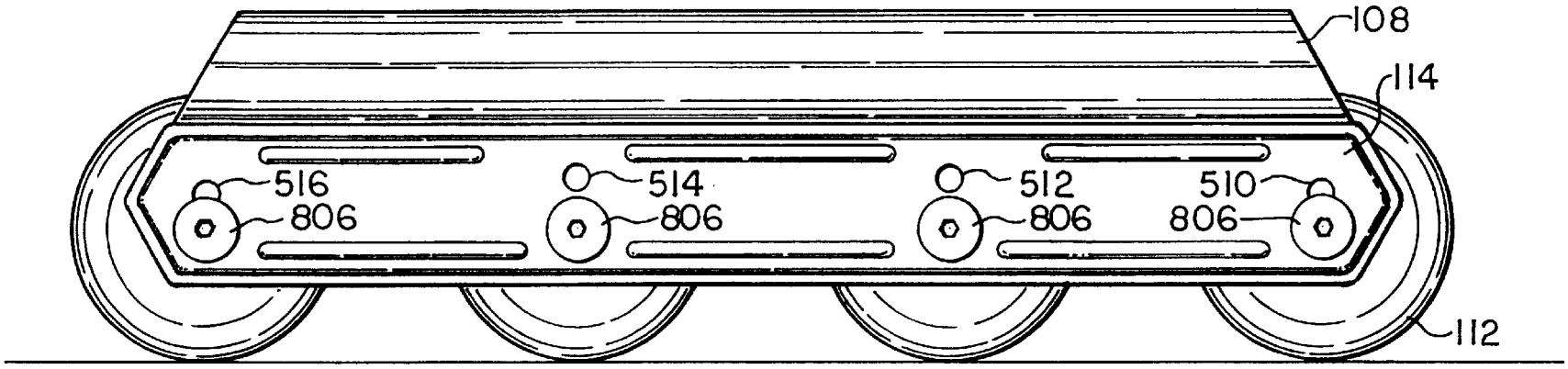
FIG. 12 shows the anti-abrasion and rockering system of the present invention with wheels in a non-rockered state.

Wheels 112 are shown in a rockered state in FIG. 11 and in a non-rockered state in FIG. 12. As shown in FIG. 11, when wheels 112 are rockered, the outermost wheels 112 are raised off the skating surface. Thus, anti-abrasion and rockering plate 114 is oriented such that axles 116 are inserted through holes 510–516 of plate 114. Because holes 510 and 516 of plate 114 are higher than holes 512 and 514, the axles 116 of outermost wheels 112 are accordingly raised. To change wheels 112 from a rockered state as shown in FIG. 11 to a non-rockered state as shown in FIG. 12, the user must remove screw 806 from axle 116 and remove axle 116 from frame 108. Once axle 116 has been removed, anti-abrasion and rockering plates 114 will fall away from frame 108. The user then rotates both plates 114 so that first row of holes 502–508 is aligned with the holes in bushings 222–228. In particular, the user must slide bushings 222 and 228 downwardly in oblong holes 214 and 220, respectively, in frame 108. Then, axles 116 can be inserted into the corresponding holes and screws 806 can be inserted into axles 116.

As shown in FIGS. 11 and 12, anti-abrasion and rockering plate 114 covers a substantial portion of the exterior of medial and lateral sidewalls 302 and 304. As such, plate 114 reduces abrasion and wear of frame 108 during use.

While the invention has been particularly shown and described with reference to preferred embodiment thereof, it will be understood by those skilled in the art that various changes in form and details may be made therein without departing from the spirit and scope of the invention.

What is claimed is:

1. An in-line skate, comprising:

a skate boot;

a chassis having two sidewalls parallel and opposite each other, said sidewalls each having a plurality of holes formed therein so that said holes align opposite each other to form a plurality of corresponding sets of holes, wherein at least two corresponding sets of holes in said chassis are oblong;

a plurality of axles, each axle disposed in one of said corresponding sets of holes in said chassis;

a plurality of wheels, each wheel disposed on one of said axles;

a bushing disposed in each hole in said two sidewalls, wherein said bushings disposed in said two oblong sets of holes slide up and down in said oblong holes; and a rockering plate disposed on each sidewall of said chassis, said rockering plates each having a first row of holes formed therein for accommodating said plurality of axles, said first row of holes being misaligned so that at least one of said wheels is at a different height relative to the skating surface than another of said wheels when said rockering plates are disposed on said sidewalls in a first position, and a second row of holes formed therein for accommodating said plurality of axles, said second row of holes being aligned so that said plurality of wheels are at the same height relative to the skating surface, when said rockering plates are disposed on said sidewalls in a second position, said second position being inverted relative to said first position.

2. The in-line skate of claim 1, wherein said chassis comprises a frame member for housing said plurality of wheels and a transition mount disposed between said frame member and said skate boot.

3. An anti-abrasion and rockering system for an in-line skate, the in-line skate having a skate boot, a chassis having a plurality of holes formed therein, at least two of said holes being oblong-shaped, the chassis being mounted to said skate boot, a plurality of axles disposed in said holes in said chassis, and a plurality of wheels disposed on said axles, said anti-abrasion and rockering system comprising:

a bushing disposed in each hole in said chassis, wherein at least two of said bushings are capable of sliding up and down in said oblong-shaped holes; and a rockering plate disposed on each side of said chassis, said rockering plates each having a first row of holes formed therein for accommodating said plurality of axles, said first row of holes being misaligned so that at least one of said wheels is at a different height relative to the skating surface than another of said wheels when said rockering plates are disposed on the sides of said chassis in a first position, and a second row of holes formed therein for accommodating said plurality of axles, said second row of holes being aligned so that said plurality of wheels are all at the same height relative to the skating surface, when said rockering plates are disposed on the sides of said chassis in a second position, said second position being inverted from said first position.

4. A method for rockering a plurality of wheels disposed on a plurality of wheel axles on an in-line skate, the skate having a chassis with a plurality of holes formed therein, at least two of the holes being oblong-shaped, and a rockering plate disposed on each side of the chassis, each rockering plate having a first row of holes which are misaligned relative to a skating surface, and a second row of holes which are aligned relative to the skating surface, comprising the steps of:

removing said plurality of wheel axles from the chassis of the skate;

removing the rockering plate from either side of said chassis;

rotating each of said rockering plates 180 degrees;

replacing said rotated rockering plates against the sides of said chassis;

sliding a plurality of bushings in a vertical direction within the oblong-shaped holes in said chassis; and reinserting said plurality of wheel axles through the misaligned first row of holes in said rotated rockering plates, through said plurality of bushings and through holes in said wheels, such that at least one of said wheels is at a different height relative to the skating surface than another of said wheels.

* * * * *